United States Patent [19]

Kim

[11] 4,302,121

[45] Nov. 24, 1981

[54] BALL-POINT PEN HAVING THREE SIDES AND COMPLEMENTARY CAP

[76] Inventor: Jung S. Kim, 5923 Carlton Way, #12, Los Angeles, Calif. 90028

[21] Appl. No.: 86,595

[22] Filed: Oct. 19, 1979

[51] Int. Cl.[3] ..... B43K 7/00; B43K 9/00

[52] U.S. Cl. ..... 401/209; 401/6; 401/98; 401/213; 401/217; D19/43; D19/49

[58] Field of Search ..... 401/6, 243, 7, 246, 401/131, 98, 209, 213, 217; D19/43, 45, 47, 49, 51

[56] References Cited

U.S. PATENT DOCUMENTS

| | | | |
|---|---|---|---|
| 22,511 | 6/1893 | Goldsmith | D19/49 |
| 181,951 | 1/1958 | Young | D19/49 |
| 1,807,415 | 5/1931 | France | 401/6 |
| 2,312,069 | 2/1943 | Baumgartner | 401/98 |
| 2,350,640 | 6/1944 | Rorke | 401/98 |
| 2,730,993 | 1/1956 | Boyle | 401/217 |

FOREIGN PATENT DOCUMENTS

| | | | |
|---|---|---|---|
| 89976 | 3/1896 | Fed. Rep. of Germany | 401/98 |
| 1033221 | 7/1953 | France | 401/217 |
| 1268355 | 6/1961 | France | 401/6 |
| 636147 | 4/1950 | United Kingdom | 401/217 |

*Primary Examiner*—Steven A. Bratlie
*Attorney, Agent, or Firm*—John T. Matlago

[57] ABSTRACT

A barrel for a ball-point pen is formed with three concave surfaces extending along the length thereof. Such a construction facilitates the firm holding of the pen barrel in an untiring manner by the thumb, forefinger and middle finger of the hand of the user. To reduce the cost of the manufacture of the pen, the ink is contained in a hole extending through the longitudinal center of the barrel.

1 Claim, 8 Drawing Figures

BALL-POINT PEN HAVING THREE SIDES AND COMPLEMENTARY CAP

BACKGROUND OF THE INVENTION

This invention relates to ball-point pens and more particularly to a novel structure therefor.

Inasmuch as ball-point pens are so widely used, it is highly desirable to reduce the number of parts needed for their construction and thus, minimize the cost of their manufacture. Furthermore, it is highly desirable to improve the structure of the barrel of the pen so that it can be more readily held in an untiring manner by the fingers of the hand of the user.

Accordingly, one of the objects of the present invention is to provide an improved ball-point pen.

Another object of the present invention is to provide a ball-point pen having a barrel with the outer surface thereof specially designed to facilitate the holding thereof firmly by the three fingers of the hand of the user.

A further object of the present invention is to provide a ball-point pen which is relatively simple in construction, economical to manufacture, and convenient to use.

With these and other objects in view the invention consists in the construction, arrangement and combination of the various parts of the device, whereby the objects contemplated are attained, as hereinafter set forth, pointed out in the appended claims and illustrated in the accompanying drawings.

DRAWING SUMMARY

PREFERRED EMBODIMENT

Figure 1:
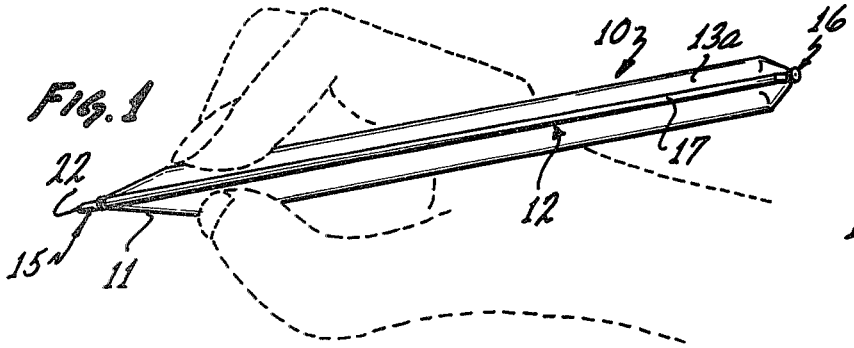
FIG. 1 is an overall perspective view showing the ball-point pen of the present invention being held in the hand of the user.

Referring to the drawings, the improved ball-point pen 10 of the present invention comprises a barrel 12 having a central hole 14 extending throughout the length thereof. A viscous ink 18 is carried in the central hole 14. The lower tapered end 11 of the barrel 12 is provided with a writing member 15 and the upper end of the barrel 12 is provided with an end plug 16. The barrel 12 is typically on the order of six inches in length.

Figure 3:
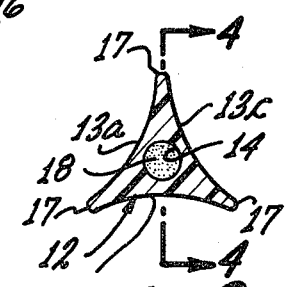
FIG. 3 is an enlarged transverse sectional view of the barrel taken on line 3—3 of FIG. 2.
Figure 2:
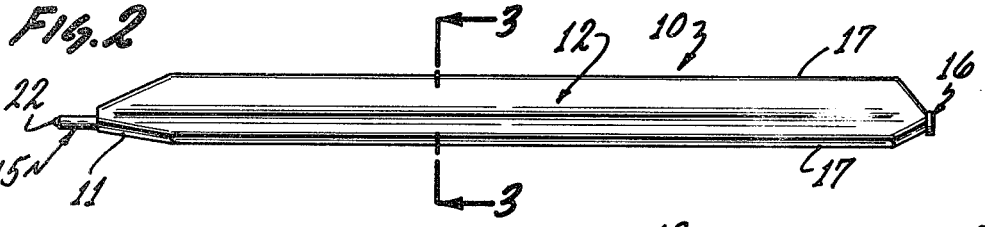
FIG. 2 is a longitudinal side view of the ball-point pen.
Figure 4:
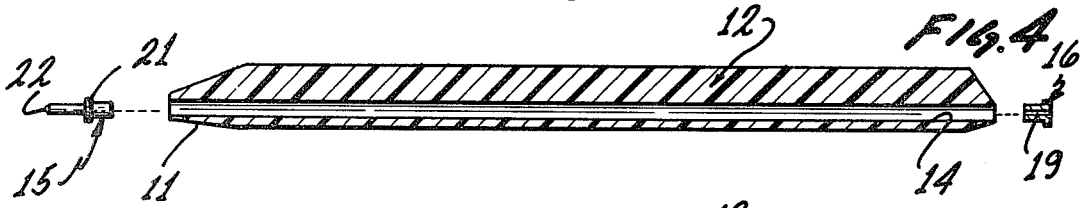
FIG. 4 is a longitudinal sectional view of the barrel as taken along line 4—4 of FIG. 3 showing the writing end member and the end plug exploded away from the respective ends thereof and the ink removed from the central hole thereof.
Figure 5:
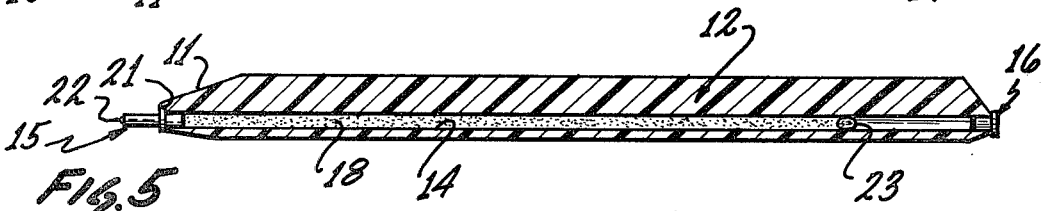
FIG. 5 is a longitudinal sectional view of the assembled barrel.
Figure 6:
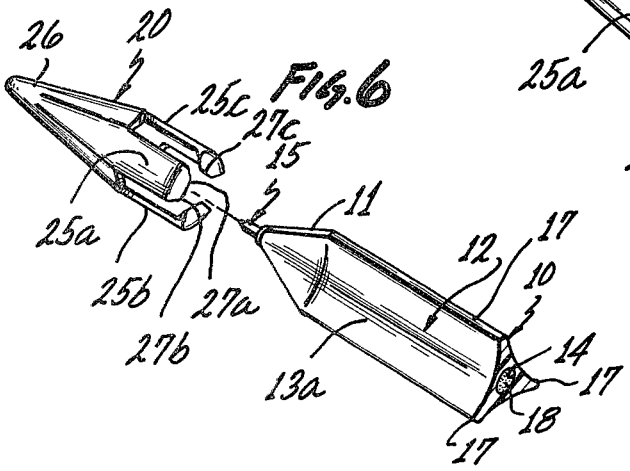
FIG. 6 is a perspective view showing the writing end portion of the barrel with the removable end cap exploded away therefrom.
Figure 7:
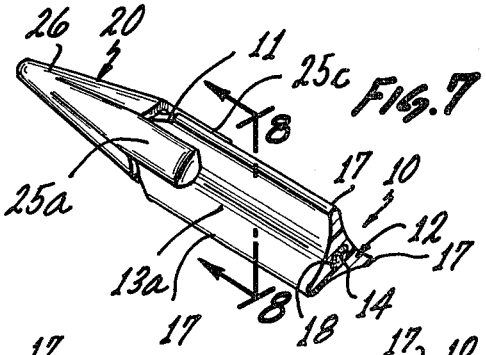
FIG. 7 is a perspective view showing the writing end portion of the barrel with the removable end cap engaged thereon.
Figure 8:
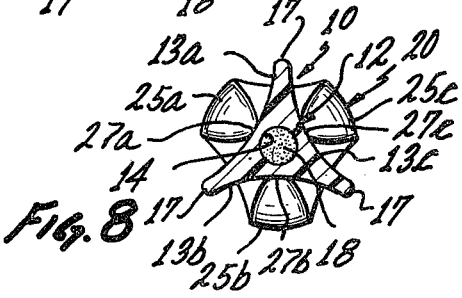
FIG. 8 is an enlarged sectional view as taken on line 8—8 of FIG. 7.

As shown in FIG. 3, the barrel 12 of the pen has a cross section typical of that of a triangular wedge or arrowhead. Thus, the outer configuration of the barrel 12 is formed with three correspondingly shaped concave surfaces 13*a*, 13*b* and 13*c*, extending along the length thereof. The adjacent edges of the concave surfaces forming the corners 17 of the triangular wedge are rounded, as shown in FIG. 3.

The writing member 15, which is conventional for ball-point pens, is provided with an axial aperture and includes a projecting steel ball 22 which is held in an end socket (not shown) in which it is free to rotate. The member 15 is provided with a collar 21 intermediate the ends thereof. The inner end of the member 15 is force fitted into the lower end of the central hole 14 of the barrel 12 with its collar 21 abutting the end thereof. The metal ball 22 serves as a writing tip. Thus, as the pen 10 moves across a paper, the rotating ball 22 picks up the ink 18 stored in the central hole 14 in the barrel 12 so as to lay down a track of the ink on the paper.

It should now be clearly understood that the barrel 12, per se, serves as a magazine for the ink 18 thus eliminating the need for providing a separate tubular magazine for the ink which is then inserted in the central hole 14 thereof, as is conventional. Instead, with the writing member 15 fitted onto the lower end of the barrel, the ink 18 is placed directly into the opening of the central hole 14 at the top of the barrel. The end plug 16 having an air vent 19 is then force fitted in the opening of the central hole in the upper end of the barrel 12. A piece of cotton 23 may be provided in the central hole adjacent the upper surface of the ink. The cotton 23, which is a porous material, prevents the ink from tending to travel toward the upper end of the barrel while still permitting air to enter to fill the void caused by the carrying off of the ink during writing.

It should now be clear, as shown in FIG. 1, that the three concave surfaces 13*a*, 13*b* and 13*c* extending along the length of the barrel provide seats for the thumb, the forefinger and the middle finger of the hand of the user to thereby enable the barrel 12 to be firmly held without the need for applying pressure to the fingers which can prove to be very tiresome especially when writing over long periods of time.

The writing end portion of the barrel 12 may be provided with a removable end cap 20. The tapered end 26 of the cap 20 is hollow and the other end thereof is formed with three equally spaced axially extending outer arms 25*a*, 25*b* and 25*c*. The peripheral end portions of each of the arms 25*a*, 25*b* and 25*c* extend radially inwardly to provide convex surfaces 27*a*, 27*b* and 27*c* shaped for mating with the concave surfaces 13*a*, 13*b* and 13*c* of the barrel 12.

When the pen is not in use, the end cap 20 is placed over the writing end of the barrel 12 such that the tapered lower end 11 thereof resides in the hollow end of the end cap 20. When so positioned, the convex surfaces 27*a*, 27*b* and 27*c* on the axially extending arms 25*a*, 25*b* and 25*c* respectively bear against the concave surfaces 13*a*, 13*b* and 13*c* of the barrel 12. Such a construction provides for the end cap 14 to be firmly held on the end of the barrel 12 and yet be readily removable therefrom.

While the ball-point pen shown and described herein is admirably adapted to fulfill the objects and advantages previously mentioned as desirable, it is to be understood that the invention is not limited to the specific features shown and described but that the means and configuration herein disclosed are susceptible of modification in form, materials, proportions, and arrangements of parts without departing from the principle involved or sacrificing any of its advantages and the invention, therefore, may be embodied in various forms within the scope of the appended claims.

What is claimed is:

1. A ball-point pen comprising:

a barrel having the length of its periphery formed by three axially extending correspondingly shaped concave surfaces so disposed as to provide a generally triangular cross section therefor with the adjacent sides of said concave surfaces joining to form the three projecting corners of the triangular cross section;

said barrel having a tapered lower end and a central bore therethrough forming a reservoir for ink;

a cylindrical writing member having an axial aperture therethrough and including a metal ball held in a socket on the outer end thereof so as to freely rotate therein;

said cylindrical writing member having a shoulder intermediate the end thereof and having its inner end portion press fitted in the bore on the lower end of the barrel with said shoulder abutting the end thereof;

a filling of viscous ink in the reservoir formed by the bore in said barrel;

an end plug provided with an air vent press fitted in the bore on the upper end of said barrel; and a removable end cap having a conical portion on one end thereof for receiving the tapered lower end of said barrel and three axially extending angularly spaced peripheral arms on the opposite end thereof, said peripheral arms having convex inner radial surfaces for respectively frictionally engaging the concave surfaces on said barrel.

* * * * *